US009833035B2

(12) United States Patent
Coburn

(10) Patent No.: US 9,833,035 B2
(45) Date of Patent: Dec. 5, 2017

(54) BOW BOOT

(71) Applicant: Michael Coburn, West Kelowna (CA)

(72) Inventor: Michael Coburn, West Kelowna (CA)

( * ) Notice: Subject to any disclaimer, the term of this patent is extended or adjusted under 35 U.S.C. 154(b) by 0 days.

(21) Appl. No.: 15/044,600

(22) Filed: Feb. 16, 2016

(65) Prior Publication Data

US 2017/0231315 A1 Aug. 17, 2017

(51) Int. Cl.

| | |
|---|---|
| ***A43B 3/02*** | (2006.01) |
| ***A43B 3/00*** | (2006.01) |
| ***A43B 1/10*** | (2006.01) |
| ***A43B 23/02*** | (2006.01) |
| ***A43C 19/00*** | (2006.01) |

(52) U.S. Cl.

CPC ..... *A43B 3/0036* (2013.01); *A43B 1/10* (2013.01); *A43B 23/0205* (2013.01); *A43C 19/00* (2013.01)

(58) Field of Classification Search

CPC ..... A43B 3/0036; A43B 3/0063; A43B 13/14; A43B 3/166; A43B 5/08; A43C 19/00

USPC ..... D2/982, 901, 903, 970, 976; 36/2 B, 36/116, 132, 133, 8.1, 70 R, 72 R; 441/61, 63, 64, 76, 77

See application file for complete search history.

(56) References Cited

U.S. PATENT DOCUMENTS 240,417 A 4/1881 Howard
703,579 A * 7/1902 Hardy ..... A41F 17/02 2/222
1,593,891 A * 7/1926 Wesala ..... A41D 17/02 36/2 B
1,717,127 A * 6/1929 Toole ..... A43B 7/32 36/4
1,963,271 A * 6/1934 Jensen ..... A41D 17/02 24/197
2,046,217 A * 6/1936 Strauss ..... A43C 13/14 36/72 R
2,054,958 A 9/1936 Tousley
2,249,553 A * 7/1941 Cataffo ..... A43C 13/14 2/22
2,555,900 A * 6/1951 Roberts ..... A43C 13/14 36/72 R
2,891,327 A * 6/1959 Leach ..... A43B 7/32 36/4
3,128,565 A * 4/1964 Graham ..... A41D 17/02 2/242
3,334,427 A * 8/1967 Edwards ..... A43B 23/26 36/72 R (Continued)

*Primary Examiner* — Ted Kavanaugh

(74) *Attorney, Agent, or Firm* — Berggren, Inc.

(57) ABSTRACT

A boot including a bow-shaped structure is disclosed to prevent water entry from the mouth of the boot. The boot generally includes a sole, an upper portion attached to the sole, a foot portion, a leg portion, and a bow-shaped structure on the front and sides of the leg portion. The edge of the bow-shaped structure tapers up towards the front of the leg portion. The bow part of the bow-shaped structure preferably project outwards 1.75 inches from the surface of the leg portion. While walking in deep water, the bow-shaped structure breaks the upward movement of the water and pushes it back down. The bow-shaped structure is molded onto the boot during the manufacturing of the boot. In a preferred embodiment of the present invention, a bow-shaped structure that can be attached to leg portion of a boot is provided.

6 Claims, 1 Drawing Sheet

(56) References Cited

U.S. PATENT DOCUMENTS

| | | | | |
|---|---|---|---|---|
| 6,094,745 | A * | 8/2000 | Fulton | A41D 17/00 2/242 |
| 6,148,544 | A | 11/2000 | Keen et al. | |
| 2010/0205717 | A1 * | 8/2010 | McClintock | A41D 13/012 2/82 |

* cited by examiner

BOW BOOT

CROSS REFERENCE TO RELATED APPLICATIONS

Not applicable.

FEDERALLY SPONSORED RESEARCH AND DEVELOPMENT

Not applicable.

MICROFICHE APPENDIX

Not applicable.

BACKGROUND OF THE INVENTION (1) Field of Invention

The present invention generally relates to a boot. More particularly, the present invention relates to "a boot that has bow-shaped structure at the front and side of the leg portion to prevent the entry of water from the mouth of the boot".

(2) Background of Invention

People commonly face the problem of water riding up the top of the boot to enter from the mouth of the boot while they walk in deep water that goes above the ankle Such deep water may be encountered during rainy weather, or in specific working environments. Water entering the boots wets the feet and legs, which not only causes discomfort to the wearer but may also cause cold. To counter this issue to some extent, rubber boots are commonly used. One of the most common types of such boots includes wellington boots, which have a flexible rubber upper portion extending to just below the knee. These boots protect the feet of the wearer from water, to some extent. Various modifications have been made to boots to provide waterproofing to the wearer. For example, U.S. Pat. No. 240,417 A, issued to Jambs H. Howabd on Apr. 19, 1881, discloses a guard made of rubber, water-proof cloth that may be attached to the top of the boot to prevent water or snow from entering the tops of rubber boots. Similarly, U.S. Pat. No. 2,054,958 A, issued to Hood Rubber Co Inc on Sep. 22, 1936, discloses a knee length high topped boot that includes an extension top made of water-proof, rubber surfaced fabric for the shedding of water. Similarly, U.S. Pat. No. 6,148,544 A, issued to Spalding Sports Worldwide, Inc. on Nov. 21, 2000, discloses a gaiter made of flexible water-proof material that is attached to vamp portion and heel collar of the upper portion of the shoe. These modification attempt to prevent water entry from the mouth of the boots, but they do not provide an effective solution to the problem when water rides higher during forward stride. Whether people walk at a normal or quickened pace, deep water generally tends to ride up the boot during the forward stride and then enter the boots from the mouth at the top of the boot. Hence, there is a need to provide a solution that can effectively prevent water from riding up the boots and find a way from the top of the boots to enter the boots and wet the feet and legs.

It is an aspect of the invention to overcome or alleviate a problem of the prior art.

This permits the use of the present invention, which enhances the prior art of boots by effectively preventing water from riding up the top of the boot and entering the mouth of the boot.

BRIEF SUMMARY OF THE INVENTION

In view of the foregoing, one aspect of the various disclosed embodiments in the present invention is to provide a boot that includes a bow-shaped structure on the front and sides of the leg portion of the boot.

Preferably, the boot including a bow-shaped structure addresses, or at least ameliorates, one or more of the problems described above. To this end, the present invention, related to a boot including a bow-shaped structure with some unique aspects, is disclosed.

Accordingly, it is a primary objective of the present invention to provide a boot that includes at least one bow-shaped structure to prevent water entry from the mouth of the boot. The boot generally includes a sole, an upper portion attached to the sole, a foot portion, a leg portion, and a bow-shaped structure on the front and sides of the leg portion.

It is another objective of the present invention that the bow-shaped structure is molded onto the boot.

It is yet another objective of the present invention that the bow-shaped structure is attached to the boot.

It is yet another objective of the present invention that the boot is made of rubber.

It is still another objective of the present invention that the boot is available in different colors and sizes.

It is yet another objective of the present invention to provide a bow-shaped structure that can be attached to the leg portion of a boot.

It is yet another objective of the present invention that the bow-shaped structure is made of rubber.

It is still another objective of the present invention that the bow-shaped structure is available in different colors and sizes.

Other objectives of the present invention will become apparent, from time to time, throughout the specification, as hereinafter related.

In this respect, before explaining at least one embodiment of the invention in detail, it is to be understood that the invention is not limited in its application to the details of construction and to the arrangements of the components set forth in the following description or illustrated in the drawings. The invention is capable of other embodiments, and of being practiced and carried out in various ways. Also, it is to be understood that the phraseology and terminology employed herein are for the purpose of description, and should not be regarded as limiting.

These, together with other objectives of the invention and the various features of novelty that characterize the invention, are pointed out with particularity in the disclosure. For a better understanding of the invention, its operating advantages, and the specific objectives attained by its uses, reference should be had to the accompanying drawings and descriptive matter, in which there are illustrated preferred embodiments of the invention.

BRIEF DESCRIPTION OF THE DRAWINGS

To further clarify various aspects of some example embodiments of the present invention, a more particular description of the invention will be rendered by reference to specific embodiments thereof, which are illustrated in the appended drawings. It is appreciated that the drawings depict only illustrated embodiments of the invention, and are, therefore, not to be considered limiting of its scope. The invention will be described and explained with additional specificity and detail through the use of the accompanying drawings, in which.

DETAILED DESCRIPTION OF THE INVENTION

The following detailed description of the present invention enables teaching of the invention and its best, currently known embodiment. Those skilled in the art can understand that many changes can be made to the embodiments described while still obtaining the beneficial results of the present invention. It will also be apparent that some of the desired benefits of the present invention can be obtained by selecting some of the features of the invention while not utilizing other features. Accordingly, those working in the relevant art will recognize that many adaptations and modification to the present invention can be made, and may be desired in certain circumstances, and are part of the present invention. Thus, the following description is provided as illustrative of the principle of the present invention.

Embodiments of the present invention provide a boot with a bow-shaped structure, which prevents water entry from the mouth of the boot while walking in deep water that goes above the ankle A bow-shaped structure is also provided, which can be attached to the leg portion of a boot. Accordingly, the specific embodiments discussed herein are merely illustrative of specific manners in which to make and use this invention, and are not intended to represent an exhaustive list of all possible structure and processes of the present invention.

Embodiments of the boot are shown in the figures, and discussed below. While the structure and processes have been described with a certain degree of particularity, it is to be noted that many modifications may be made in the details of the structure and processes without departing from the spirit and scope of this disclosure. It is understood that the structure and processes are not limited to the embodiments set forth herein for purposes of exemplification.

Aspects of the present inventive subject matter are described with reference to the figures provided herein.

Figure 1:
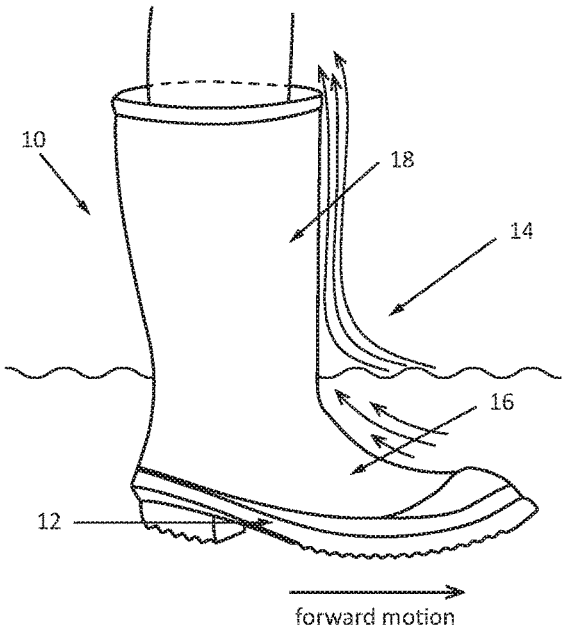
FIG. 1 shows a perspective view of a boot.

FIG. 1 illustrates an exemplary representation of a long boot extending to just below the knees that is generally available in market. The long boot 10 includes a sole 12, an upper portion 14 attached to the sole 12, a foot portion 16, and a leg portion 18. The upper portion 14 of the boot can prevent direct contact with the water, to some extent. However, when a person wearing this long boot walks in deep water, the water travels upwards during forward strides, as shown in the figure, and tends to reach the top of the boot without any hindrance. The water can easily enter the boot via mouth of the boot to wet the socks, feet, and legs.

Figure 2:
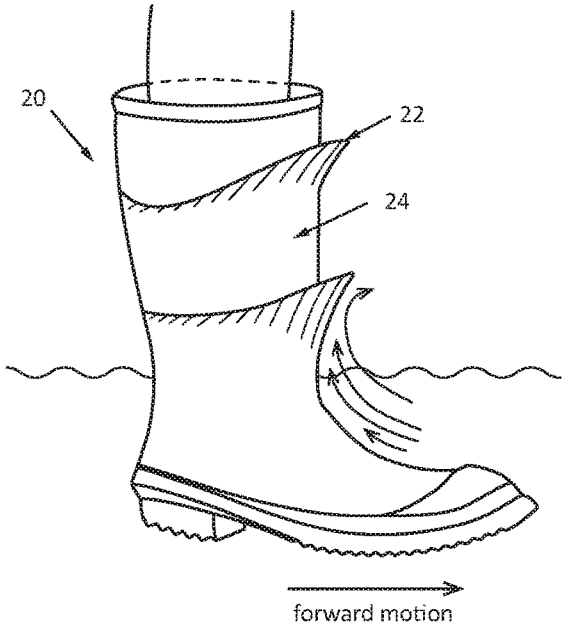
FIG. 2 shows a perspective view of a boot with bow shaped structures.

The present invention provides a boot including at least one bow-shaped structure to prevent water entry from the mouth of the boot. The boot generally includes a sole, an upper attached to the sole and including a foot portion and a leg portion, and a bow shaped structure in the front and sides of the leg portion. The edge of the bow shaped structure tapers up towards the front of the leg portion. The bow part of the bow-shaped structure preferably project outwards 1.75 inches from the surface of the leg portion. While walking in deep water, as the water moves upwards on the boot, the bow shaped structure breaks this movement of the water and push it back down, as shown in FIG. 2. The water is thus not allowed to channel up the boot to reach the top of the boot. Hence, due to the presence of the bow shaped structures on the boot, water cannot enter via mouth of the boot.

The present invention provides a boot (20) comprising a sole (12), an upper portion (14) attached to said sole, said upper portion comprising a foot portion (16), a leg portion (18) having a front and two boot sides, and at least one water directing structure (24), the water directing structure extending around the leg portion and consisting of a lower part attached to the leg portion, and an upper horizontal edge having a height (shown in FIG. 2 with shading) larger at the front of the boot than at the boot sides and forming a lip (22) extending away from the leg portion.

This bow shaped structure may preferably be molded on the boot during the manufacturing of the boot. In a preferred embodiment, the boot has a single bow-shaped molding on the front and sides of the leg portion. In another embodiment of the present invention, as shown in FIG. 2, the boot 20 has two or more bow shaped structures 22 that are molded onto the front and sides of the leg portion 24, where the two or more bow-shaped molding are vertically arranged one above the other. The boot is preferably made of rubber. The boot may be provided in different colors and sizes.

The present invention also provides a bow shaped structure that can be attached to the front and sides of the leg portion of the boot to prevent the entry of water from the mouth of the boot while walking in deep water that goes over the ankle. The bow shaped structure is preferably attached midway up the leg portion of the boot. The bow-shaped structure is preferably made of rubber. Furthermore, the bow-shaped structure is provided in different colors and sizes for use with different boots by people of different ages.

It is to be understood that the above description is intended to be illustrative, and not restrictive. For example, the above discussed embodiments may be used in combination with each other. Many other embodiments will be apparent to those of skill in the art upon reviewing the above description.

Whereas the construction and method have been described in relation to the figures of the drawings, it should be understood that other and further modifications, apart from those shown or suggested herein, may be made within the spirit and scope of this invention.

What is claimed is:

1. A boot comprising:

a sole, an upper portion attached to said sole, said upper portion comprising a foot portion, a leg portion having a front and two boot sides, and at least one water directing structure, the water directing structure extending around the leg portion and consisting of a lower part attached to the leg portion, and an upper horizontal edge having a height larger at the front of the boot than at the boot sides and forming a lip extending away from the leg portion.

2. The boot of claim 1, wherein said boot has one water directing structure.

3. The boot of claim 1, wherein said boot has two water directing structures one above another.

4. The boot of claim 1, wherein the lip projects outwards 1.75 inches from surface of said leg portion.

5. The boot of claim 1, wherein said the lower part of the water directing structure is molded on said leg portion.

6. The boot of claim 1, wherein said boot is made of rubber.

* * * * *